US005575381A

United States Patent [19]

Castonguay et al.

[11] Patent Number: 5,575,381

[45] Date of Patent: Nov. 19, 1996

[54] INTERLOCK FOR HIGH AMPERE-RATED CIRCUIT BREAKER CONTACT CLOSING SPRINGS

[75] Inventors: Roger N. Castonguay, Terryville; Mark A. Zaffetti, Windsor Locks; James L. Rosen, West Hartford, all of Conn.

[73] Assignee: General Electric Company, New York, N.Y.

[21] Appl. No.: 315,385

[22] Filed: Sep. 30, 1994

[51] Int. Cl.[6] ..... H01H 23/00

[52] U.S. Cl. ..... 200/401; 200/400

[58] Field of Search ..... 200/400, 401; 335/16, 21, 6, 7, 9, 15, 18; 74/2

[56] References Cited

U.S. PATENT DOCUMENTS

| | | | |
|---|---|---|---|
| 3,590,192 | 6/1971 | Bould | 200/400 |
| 3,832,504 | 8/1974 | Cellerini et al. | 200/400 |
| 4,001,742 | 1/1977 | Jenck et al. . | |
| 4,019,008 | 4/1977 | Kohler et al. | 200/400 |
| 4,658,323 | 4/1987 | Dougherty . | |
| 4,801,907 | 1/1989 | Kelaita, Jr. et al. . | |

OTHER PUBLICATIONS

Castonguay et al, "Rating Module Unit for High Ampere-rated Circuit Breaker" U.S. S/N: 08/203,052 (Docket: 41PR-7124) Filed Feb. 28, 1994.

Castonguay et al, "Handle Operator Assembly for High Ampere-rated Circuit Breaker" U.S. S/N: 08/214,522 (Docket: 41PR-7130) Filed Mar 18, 1994.

Zaffetti et al, "Handle Interlock Arrangement for a High Ampere-rated Circuit Breaker" U.S. S/N: 08/265,377 (Docket: 41PR-7135) Filed Jun. 23, 1994.

Castonguay et al, "A Positive Charge Indicating for High Ampere-rated Circuit Breaker Operating Springs" U.S. S/N 08/304331-Sep. 12, 1994 (Docket; 41PR-7137).

Zaffetti at al, "Sequential Close Interlock Arrangement for High Ampere-rated Circuit Breaker" U.S. S/N 08/266,409 (Docket: 41PR-7138) Filed Jun. 27, 1994.

*Primary Examiner*—David J. Walczak

*Attorney, Agent, or Firm*—Richard A. Menelly; Carl B. Horton

[57] ABSTRACT

This invention relates to a high ampere-rated circuit breaker which meets the electrical code requirements of the world market. The charging of the powerful closing springs controlling the circuit breaker contacts is made manually by means of a ratchet and pawl assembly. A logic plate interacts with a logic lever, an interlock link and a closing link to prevent the circuit breaker closing button from operating until and unless the closing springs have become fully-charged.

17 Claims, 4 Drawing Sheets

INTERLOCK FOR HIGH AMPERE-RATED CIRCUIT BREAKER CONTACT CLOSING SPRINGS

BACKGROUND OF THE INVENTION

U.S. Pat. No. 4,001,742 entitled "Circuit Breaker Having Improved Operating Mechanism" describes a circuit breaker capable of interrupting several thousand amperes of circuit current at several hundred volts potential. As described therein, the operating mechanism controls the powerful operating springs that open and close the circuit breaker contacts. Once the operating mechanism has responded to separate the contacts, the operating springs must be recharged to supply sufficient motive force to the movable contact arms that carry the contacts.

U.S. patent application Ser. No. 08/218,287 filed on 28 Mar. 1994 entitled "Handle Operator Assembly for High Ampere-rated Circuit Breaker" describes an assembly for manually charging the circuit breaker contact closing springs.

U.S. patent application Ser. No. 08/214,522 filed on 3 Mar. 1994 entitled "Latching Arrangement for High Ampere-rated Circuit Breaker" describes the latching arrangement used to retain the powerful operating mechanism springs from driving the circuit breaker contacts to the closed position.

U.S. patent application Ser. No. 08/265,877 entitled filed on 27 Jun. 1994 "Handle Interlock Arrangement for High Ampere-Rated Circuit Breakers" describes restraining the circuit breaker operating handle after the circuit breaker contact closing springs have become fully charged.

U.S. patent application Ser. No. 08/304,331 entitled "Positive Charge Indicator Arrangement for High Ampere-Rated Circuit Breaker" describes interlocking the circuit breaker charging springs indicator flag by means of a logic plate and logic lever to prevent the charge indicating flag from signaling until and unless the closing springs are fully charged.

U.S. patent application Ser. No. 08/266,409 filed on 27 Jun. 1994 entitled "Sequential Close Interlock Arrangement for a High-Rated Circuit Breaker" describes the interaction between a closing link and the circuit breaker contact closing springs button to prevent operation of the closing button unless the closing springs are fully charged.

The purpose of this invention is to interlock the circuit breaker contact closing springs per se to prevent release of the closing springs when the contact springs are only partially charged.

SUMMARY OF THE INVENTION

In a high ampere-rated circuit breaker including contact closing springs for closing the circuit breaker contacts, the externally-accessible contact springs closing button interacts with a logic plate, a logic lever, an interlock link and a closing link to prevent the closing button from releasing the closing springs until and unless the closing springs have become fully charged.

DESCRIPTION OF THE PREFERRED EMBODIMENT

Figure 1:
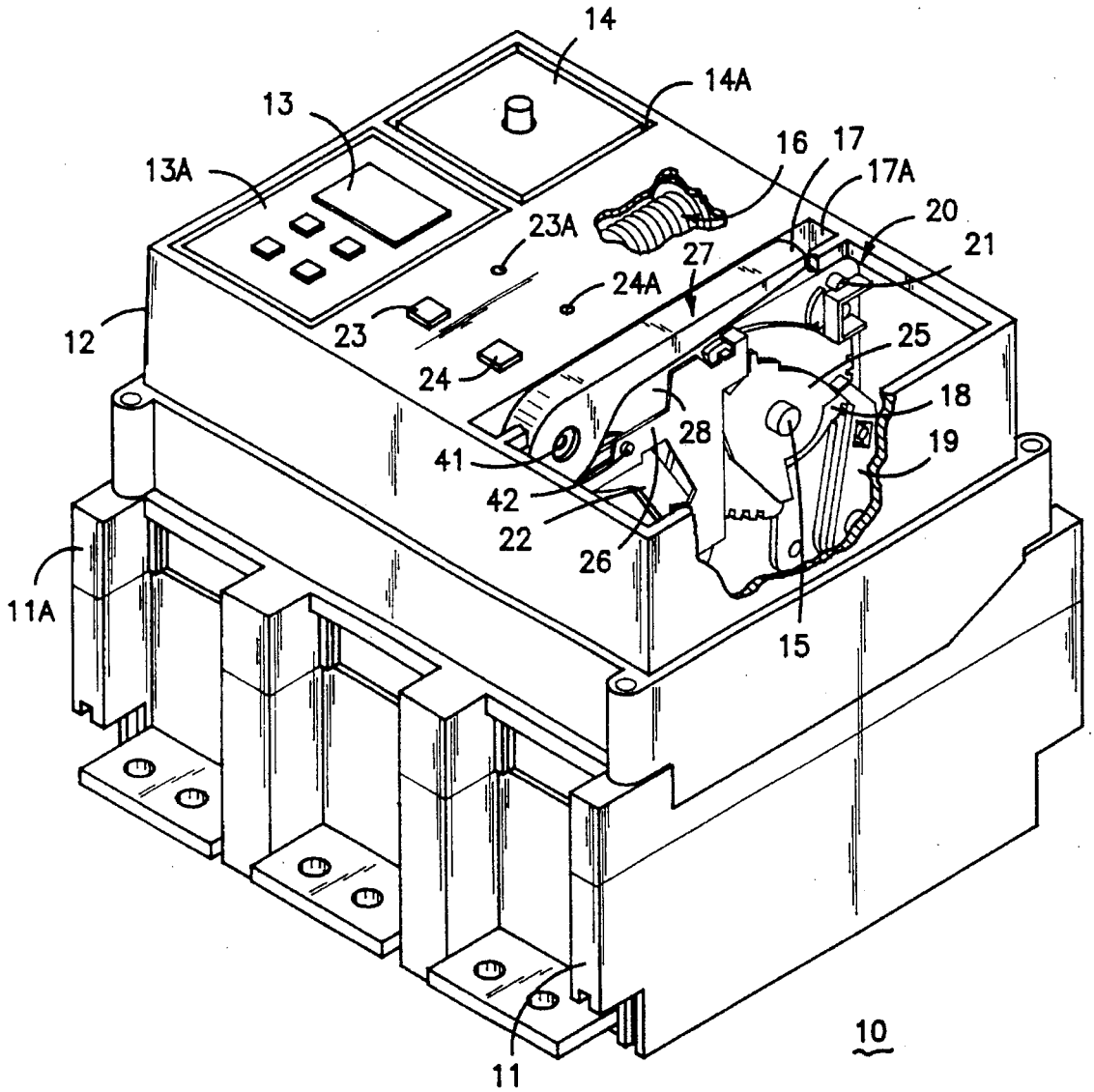
FIG. 1 is a top perspective view of a high ampere-rated circuit breaker with a portion of the circuit breaker cover removed to depict the contact closing springs interlock assembly according to the invention.

The high ampere-rated circuit breaker 10 shown in FIG. 1 is capable of transferring several thousand amperes quiescent circuit current at several hundred volts potential. The circuit breaker consists of an electrically insulated base 11 to which an intermediate cover 11A of similar insulative material is attached prior to attaching the top cover 12 also consisting of an electrically-insulative material. Electrical connection with the interior current-carrying components is made by load terminal straps extending from one side of the base and line terminal straps (not shown) extending from the opposite side thereof. The interior components are controlled by an electronic trip unit 13 contained within a recess 13A on the top surface of the top cover 12 The trip unit is similar to that described within U.S. Pat. No. 4,658,323 and interacts further with an accessory 14 within an accessory recess 14A to provide a range of protection and control functions such as described, for example within U.S. Pat. No. 4,801,907. The operating mechanism as described within U.S. patent application Ser. No. 08/203,062 filed on 28 Feb. 1994 entitled "Rating Module Unit for High Ampere Rated Circuit Breakers includes a closing shaft 15 which provides the forces required to charge the powerful operating mechanism contact closing springs 16. The operating handle 17 arranged within the handle recess 17A allows manual operation of the circuit breaker operating mechanism as well as providing manual means for charging the contact closing springs. The handle is attached to the operating mechanism sideframe 28 by means of the handle pivot pin 41 and is connected with the handle drive gear 18 by a pair of handle drive links 22. The handle drive gear interacts with a locking pawl 19 to restrain the handle drive gear from reverse rotation during the contact operating spring charging process as described in the aforementioned U.S. patent application Ser. No. 08/214,522. The primary and intermediate latches 20, 21 restrain the operating mechanism from responding when the closing springs have become fully charged. To turn on the circuit breaker by moving the circuit breaker contacts within the base to the closed condition, the closing button 24 is depressed to release the closing springs. The CLOSED indicating flag which is associated with the closing button is visible under the closed indicating flag access slot 24A. The circuit breaker contacts are turned off by means of the opening button 23 and the OPEN indicating flag associated with the opening button is visible under the open indicating flag access slot 23A. In accordance with the invention, a closing springs interlock assembly 27 in the form of a logic plate 25 and interlock link 26 insures that the closing button 24 cannot release the closing springs unless, and until, the closing springs are fully charged.

Figure 2:
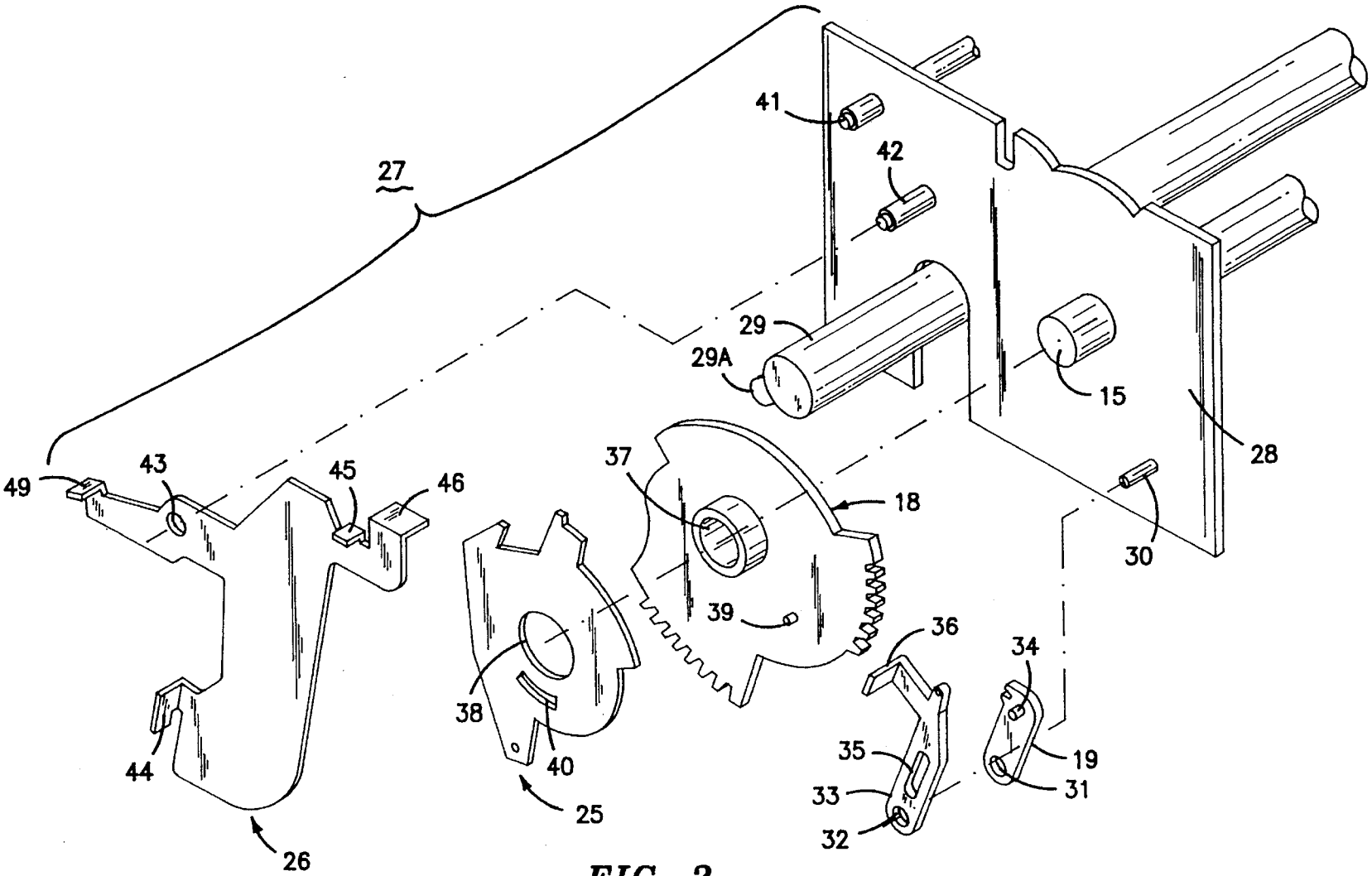
FIG. 2 is an enlarged top perspective view of the contact closing springs interlock assembly of FIG. 1 with the components in isometric projection.

The interlock assembly 27 is shown apart from the circuit breaker in FIG. 2 to depict the location of the interlock link 26, logic plate 25 and handle drive gear 18 relative to the handle pivot 41, interlock link pivot 42, drive shaft 29 closing shaft 15 and locking pawl pivot 30 on the side frame 28. The components within the interlock assembly are similar to those described within the aforementioned U.S. patent application Ser. No. 08/304,331. The locking pawl 19 is arranged on the pivot pin 30 by means of the thru-hole 31 and the pin 34 on the locking pawl extends through the slot 35 formed on the logic lever 33. The same pin 30 extends through the thru-hole 32 on the logic lever so that the pivot pin 30 is common to both the locking pawl and the logic lever. The handle drive gear 18 and the logic plate 25 are assembled on the closing shaft 15 by means of the openings 37, 38 respectively and the pin 39 extending from the handle drive gear 18 is captured within the slot 40 formed in the logic plate 25 to allow lost motion between the drive gear and the logic plate until the pin 39 contacts the edge of the slot 40 and causes the logic plate to move in unison with the drive gear as described within the aforementioned U.S. patent application Ser. No. 08/304,331. As further described therein, the tab 36 on the logic lever 33 interacts with the outer perimeter of the logic plate 25 to set the position of the indicating flag relative to the charged and uncharged conditions of the contact closing springs 16 (FIG. 1). The interlock link 26 is mounted on the sideframe 28 by means of the pivot pin 42 and interacts with the logic plate 25 by means of the offset tab 46. The interlock link interacts with the cam 29A on the closing shaft 29 by means of the offset tab 44 and with the operating handle by means of the slot 50 (FIG. 3) at one end of the operating handle 17 (FIG. 1).

Figure 3:
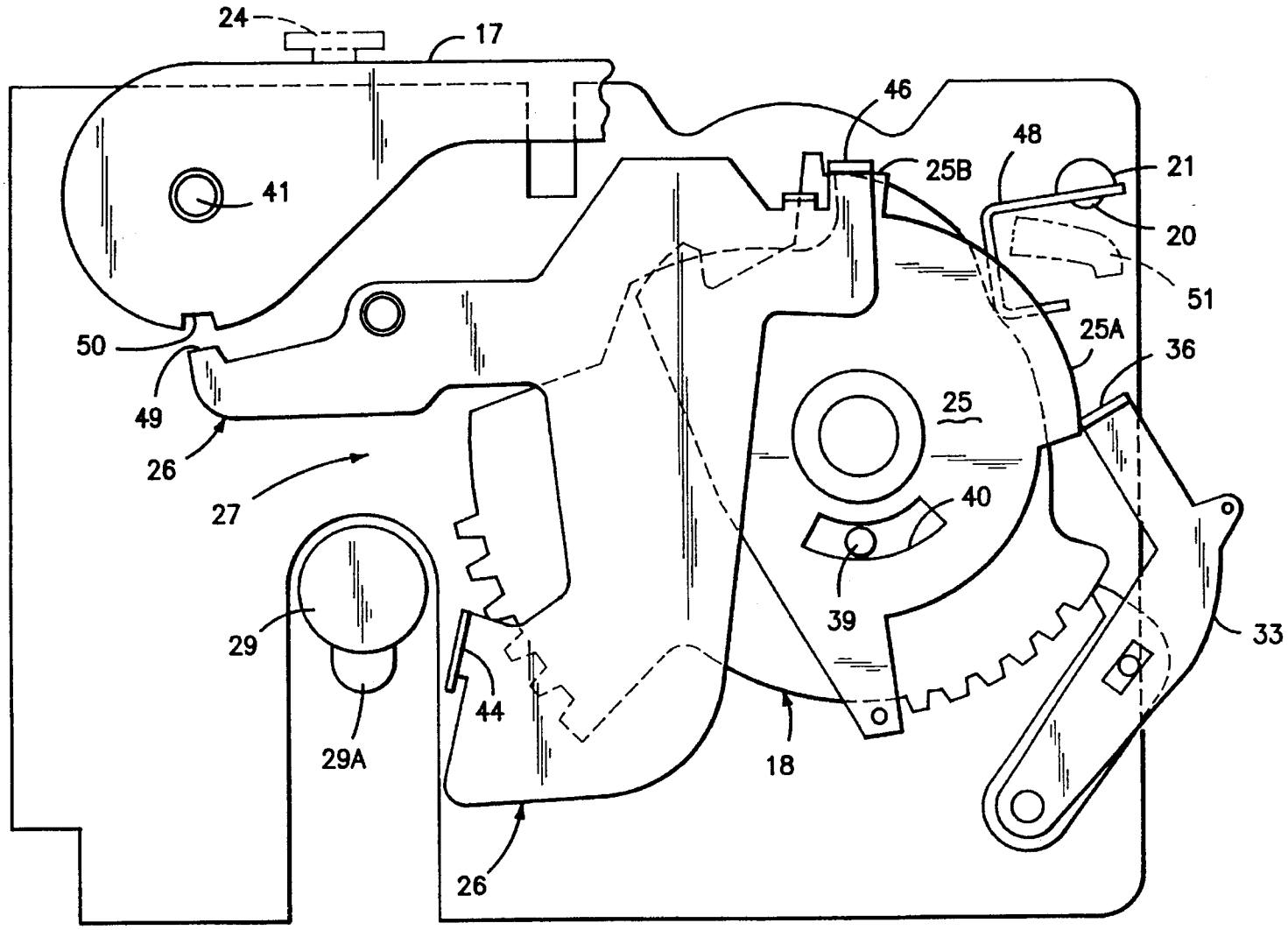
FIG. 3 is an enlarged plan side view of the contact closing springs interlock assembly of FIG. 1 with the circuit breaker closing springs in a discharged condition.
Figure 4:
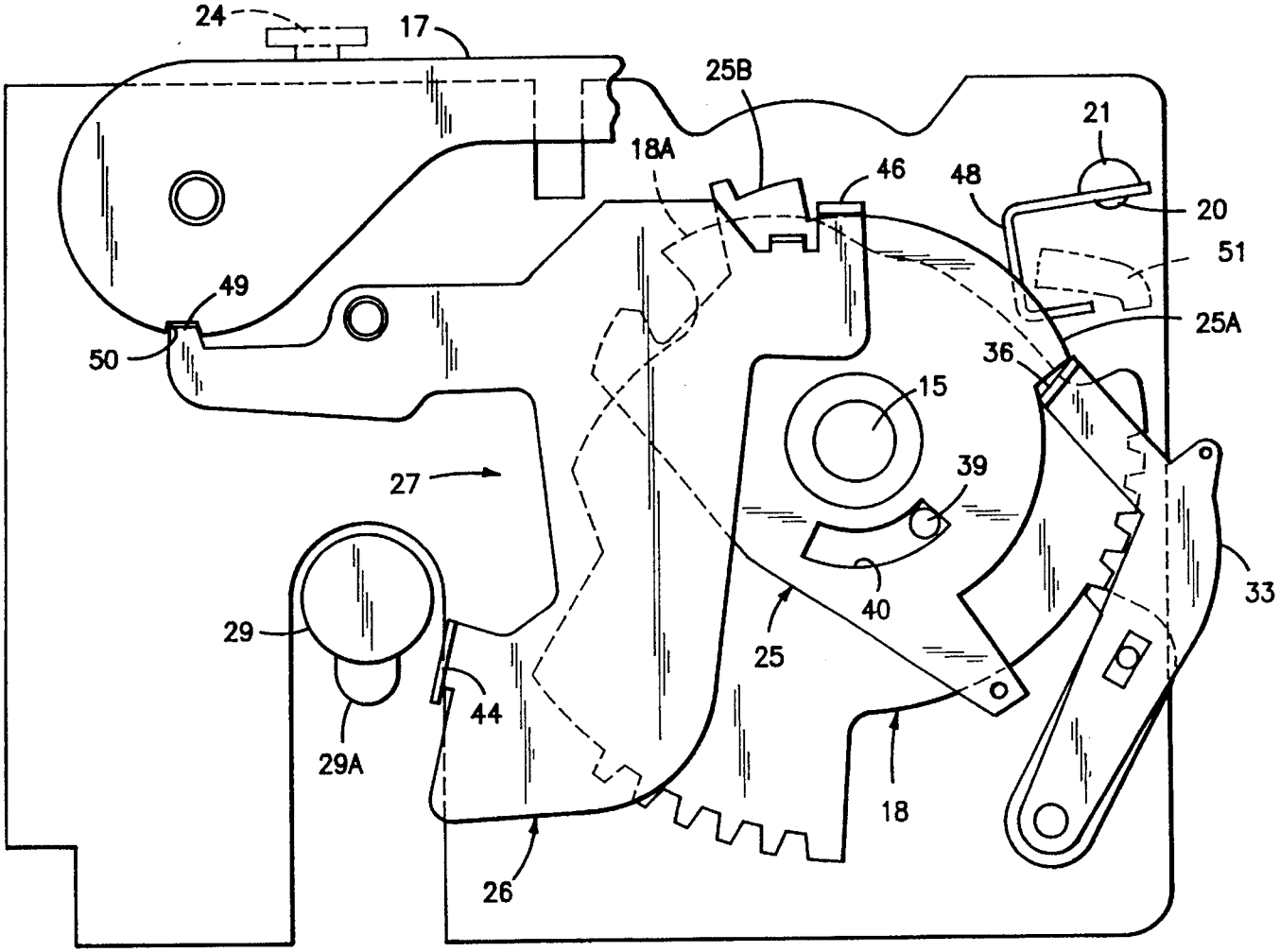
FIG. 4 is an enlarged plan side view of the contact closing springs interlock assembly of FIG. 1 with the circuit breaker closing springs in a fully-charged condition.

The interlock link further interacts with the closing link 51 by means of a slot (not shown) within the closing link as best seen by now referring to the closing spring interlock assemblies 27 depicted in FIGS. 3 and 4.

The interlock link 26 interacts with the closing link 51 to prevent the closing link from contacting the latch bracket 48 and thereby release the primary and secondary latches 21, 20 as described within the aforementioned U.S. patent application Ser. No. 08/266,405 when the closing button 24 is depressed and the contact charging springs are less then fully charged as with the interlock assembly 27 shown in FIG. 3. The operating handle 17 is positioned on the handle pivot 41 with the handle interlock slot 50 away from the handle interlock tab 49 at one end of the interlock link 26. The reset-lockout tab 46 on the interlock link 26 is positioned on the detent 25B on the perimeter of the logic plate 25 and the cam 29A on the drive shaft 29 is away from the positioning tab 44 on the interlock link since the circuit breaker contacts are in the open condition. In this position, the pin 39 on the handle drive gear 18 is away from the edge of the slot 40 within the logic plate 25 which allows the drive shaft 29 to rotate without rotating the logic plate and displacing the locking lever tab 36 on the logic lever 33 away from the cam surface 25A until the contact charging springs have become fully charged as described within the aforementioned U.S. patent application Ser. No. 08/304,331.

When the contact closing springs have become fully charged, as shown within the interlock assembly 27 in FIG. 4, the handle interlock tab 49 on the end of the interlock link 26 sits within the handle interlock slot 50 at the end of the operating handle 17 and the positioning tab 44 on the bottom of the interlock link is away from the cam 29A on the drive shaft 29. When the circuit breaker contact are open, the pin 39 on the handle drive gear 18 has contacted the edge of the slot 40 on the logic plate 25 to rotate the logic plate and allow the locking lever tab 36 on the logic lever 33 to drop away from the cam surface 25A and to allow the reset lockout tab 46 to drop away from the detent surface 25B on the logic plate. The closing link 51, as shown in phantom, is now in line with the latch bracket 48 which allows the closing button 24 also shown in phantom at the opposite end of the closing link to drive the end of the closing link against the latch bracket to thereby release the primary and secondary latches 20, 21 and allow the closing shaft 15 to rotate and release the contact closing springs back to the discharged position shown in FIG. 4. At the same time, the camming surface 18A on the handle drive gear 18 becomes positioned under the reset-locktab tab 46 to lift the reset-locktab back onto the detent surface 25 as indicated.

A contact closing spring arrangement 27 has herein been described wherein an interlock link 26 interacts with the circuit breaker operating handle 17, drive shaft 29, logic plate 25 and closing link 51 to sequentially allow the contact closing button to release the contact closing springs as soon as the contact closing springs have become fully charged.

We claim:

1. An interlock arrangement for circuit breaker contact closing springs comprising:

a sideframe assembly within a circuit breaker to support circuit breaker operating components;

a logic plate arranged on a handle drive gear, said logic plate and said drive gear being concentrically mounted on a circuit breaker operating mechanism closing shaft;

a logic lever pivotally-attached to said sideframe and interacting with said logic plate and with a locking pawl to control rotation of said logic lever relative to rotation of said drive gear; and an interlock link pivotally-attached to said sideframe and interacting with a circuit breaker closing link to prevent operation of a circuit breaker closing button until circuit breaker contact closing springs have become fully charged.

2. The interlock arrangement of claim 1 wherein said interlock link includes an off-set tab captured within a closing link.

3. The interlock arrangement of claim 2 wherein said closing link moves in and out of contact with a circuit breaker latch release bracket depending upon movement of said interlock link.

4. The interlock arrangement of claim 3 wherein said interlock link includes a reset-lockout tab extending from one end and interacting with a detent surface on a logic plate to hold said closing link out of contact with said latch release bracket until said contact closing springs are fully-charged.

5. The interlock arrangement of claim 4 wherein said interlock link includes a handle interlock tab arranged for capture within a handle interlock slot on one end of an operating handle when said contact closing springs are fully-charged.

6. The interlock arrangement of claim 4 wherein said interlock link includes a positioning tab on a bottom thereof for interacting with a cam on a drive shaft.

7. The interlock arrangement of claim 6 wherein said logic plate includes a logic plate slot and said drive gear includes a drive gear pin, said drive gear pin extending within said logic plate slot for providing lost motion between said logic plate and said drive gear.

8. The interlock arrangement of claim 6 wherein said locking pawl includes a locking pawl pin and said logic lever includes a locking lever slot, said locking pawl pin being captured within said locking lever slot for moving said logic lever in unison with said locking pawl.

9. A circuit breaker having an externally-accessible contact springs release button comprising:

an insulative base and cover;

contact closing springs under said cover and arranged for closing associated circuit breaker contacts;

a closing button accessible from said cover and arranged for releasing said contact closing springs; and a contact closing springs interlock assembly arranged on an operating mechanism sideframe within said base, said interlock assembly preventing said closing button from releasing said contact closing springs until and unless contact closing springs are fully-charged.

10. The circuit breaker of claim 9 wherein said interlock assembly includes a logic plate arranged on a handle drive gear, said logic plate and said drive gear being concentrically mounted on a circuit breaker operating mechanism drive shaft.

11. The circuit breaker of claim 10 wherein said interlock assembly further includes a logic lever pivotally-attached to said sideframe and interacting with said logic plate and with a locking pawl to control rotation of said logic levee pivotally-attached to said sideframe logic plate relative to rotation of said drive gear.

12. The circuit breaker of claim 10 wherein said interlock assembly further includes an interlock link pivotally-attached to said sideframe and interacting with a circuit breaker closing link to prevent operation of a circuit breaker closing button until circuit breaker contact closing springs have become fully charged.

13. The circuit breaker of claim 12 wherein said interlock link includes an off-set tab captured within said closing link.

14. The circuit breaker of claim 12 wherein said closing link moves in and out of contact with a circuit breaker latch release bracket depending upon movement of said interlock link.

15. The circuit breaker of claim 14 wherein said interlock link includes a reset-lockout tab extending from one end and interacting with a detent surface on said logic plate to hold said closing link out of contact with said latch release bracket until said contact closing springs have become fully shaped.

16. The circuit breaker of claim 12 wherein said logic plate includes a logic plate slot and said drive gear includes a drive gear pin, said drive gear pin extending within said logic plate slot for providing lost motion between said logic plate and said drive gear.

17. The circuit breaker of claim 15 wherein said reset lockout tab becomes first positioned on a camming surface on said handle drive gear and then becomes positioned on detent surface on said logic plate.

* * * * *